United States Patent [19]

Lopez

[11] 4,199,098

[45] Apr. 22, 1980

[54] CONTAINER POLYGONAL IN CROSS-SECTION COLLAPSIBLE TO FLAT CONDITION

[75] Inventor: Louis R. Lopez, Leominster, Mass.

[73] Assignee: Corrugated Paper Corporation, Westboro, Mass.

[21] Appl. No.: 967,836

[22] Filed: Dec. 8, 1978

[51] Int. Cl.[2] ..... B65D 5/36

[52] U.S. Cl. ..... 229/41 C; 229/37 R

[58] Field of Search ..... 229/41 C, 39, 37

[56] References Cited

U.S. PATENT DOCUMENTS

| | | | |
|---|---|---|---|
| 2,044,103 | 6/1936 | Rossi | 229/41 C UX |
| 2,085,239 | 6/1937 | Towell | 229/41 C |
| 2,741,416 | 4/1956 | Hileman | 229/41 C |
| 2,761,611 | 9/1956 | Benschoter | 229/37 |
| 2,826,350 | 3/1958 | Marx | 229/37 |
| 3,032,254 | 5/1962 | Wilson | 229/37 |
| 3,101,167 | 8/1963 | Styler | 229/41 C |
| 3,174,675 | 3/1965 | Rosenburg, Jr. | 229/41 C |
| 3,700,161 | 10/1972 | Bundy | 229/41 C |
| 3,901,431 | 8/1975 | Carlson | 229/41 C X |
| 4,146,169 | 3/1979 | Meyers et al. | 229/41 C |

*Primary Examiner*—Davis T. Moorhead

*Attorney, Agent, or Firm*—Norman S. Blodgett; Gerry A. Blodgett

[57] ABSTRACT

Container having a tubular main body consisting of a plurality of rectangular panels hinged together to give a polygonal cross-section, which body can be collapsed to a flat condition.

10 Claims, 8 Drawing Figures

CONTAINER POLYGONAL IN CROSS-SECTION COLLAPSIBLE TO FLAT CONDITION

BACKGROUND OF THE INVENTION

In the transportation and storage of particulate materials, such as plastic beads for use in the plastic industry, it is common practice to use a drum made of fiberboard. Such containers are not collapsible; therefore, even though they are quite expensive, it is common practice not to ship them back to the point of origin. The cost of such one-way, non-reusable container is reflected in the cost of the product being shipped. Attempts to develop a container formed of a less expensive material, such as corrugated board, and one which is also collapsible for return shipment, have been less than successful. This is because the prior art constructions have been incapable of retaining powdered and particulate materials without leakage. The non-collapsible barrel is an added problem at the factory where the particulate material is produced, because of the fact that the container takes up so much space while in storage waiting to be used. In addition, the fiberboard container is quite heavy in proportion to its volume and this extra weight represents a shipping cost which is usually passed onto the consignee, whether or not the shipping cost is designated on his invoice as such. These and other difficulties experienced with the prior art devices have been obviated in a novel manner by the present invention.

It is, therefore, an outstanding object of the invention to provide a container which is collapsible and which is capable of containing particulate material without leakage.

Another object of this invention is the provision of a container formed of a single piece of corrugated board having a high strength, leak-proof bottom structure.

A further object of the present invention is the provision of a container which is light in weight and which, nevertheless, is capable of carrying high-density powders and particulate materials without leakage.

It is another object of the instant invention to provide a container formed of corrugated board which can be collapsed into a flat condition for storage and shipment.

A still further object of the invention is the provision of a container formed of a single piece of corrugated board having a high-strength, anti-leak bottom structure.

It is a further object of the invention to provide a container formed of a single piece of corrugated board having a closure structure with an integral pouring spout.

It is still a further object of the present invention to provide a container bottom structure including a panel which is supported beneath by straps and tabs all of which lie in substantially the same plane and occupies essentially the entire area under the panel, so that the panel cannot be distorted by fungible contents.

With these and other objects in view, as will be apparent to those skilled in the art, the invention resides in the combination of parts set forth in the specification and covered by the claims appended hereto.

SUMMARY OF THE INVENTION

In general, the invention consists of a barrel-like container formed of a single piece of corrugated board and collapsible for storage and shipment. It is provided with a main body consisting of an even number of rectangular panels connected along the hinge lines in series to form a tube. This body is foldable into a flat condition along opposite hinge lines to define an interior plane. A bottom panel is provided having the form of a regular polygon having the said even number of edges, one edge of the panel being hingedly connected to the bottom edge of a first one of the panels. The said one of the panels is located between the said opposite hinge lines, so that the bottom panel can be folded into the interior plane of the main body when it is folded. A locking tab is hingedly attached to the bottom edge of a second one of the panels, the locking tab having a fold line extending across its mid-point to divide it into a free portion and a glue portion. The glue portion is permanently attached to the bottom panel with the fold line lying in the said interior plane. Two web elements are provided to support the bottom panel, each having a fold line which also lies in the said plane. Each web element consists of two generally triangular tabs hingedly connected to the bottom edges of adjacent panels, one of the tabs having a glue extension for permanent attachment to the other tab. The web elements and the locking tabs are formed with matching edges, so that they lie in the same plane under the bottom panel and extend non-co-extensively over substantially the entire area thereof, thus supporting the entire under-surface of the panel in a single plane to avoid distortion.

More specifically, sealing flanges are provided along many of the edges of the bottom panel and extend upwardly along the inner surface of the main body. The upper end of the main body is provided with a plurality of closure panels hingedly connected to the said panels of the main body. One primary closure panel is capable of extending at least one-half the distance across the upper end of the main body and has a panel portion on either side to form with it an openended envelope. A secondary closure panel is located opposite the primary closure panel to also extend a substantial distance across the top of the main body. The secondary closure panel has an extension adapted to fit snugly in the said envelope to lock the closure panels in closed position across the top of the main body.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
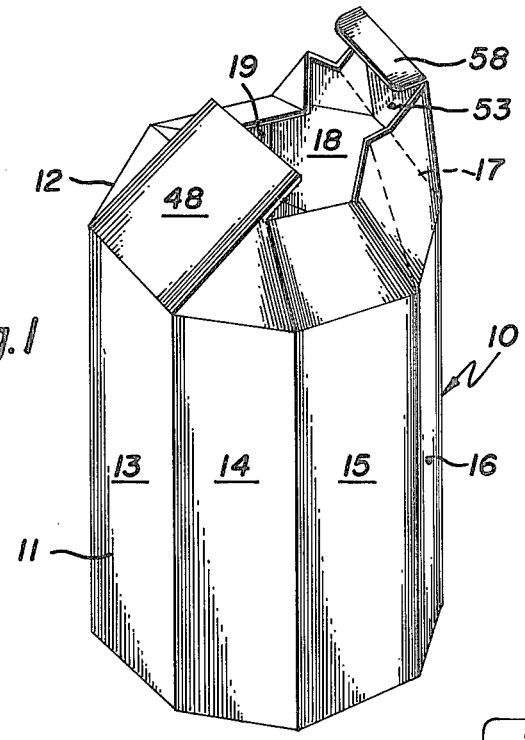
FIG. 1 is a perspective view of a container embodying the principles of the present invention.
Figure 2:
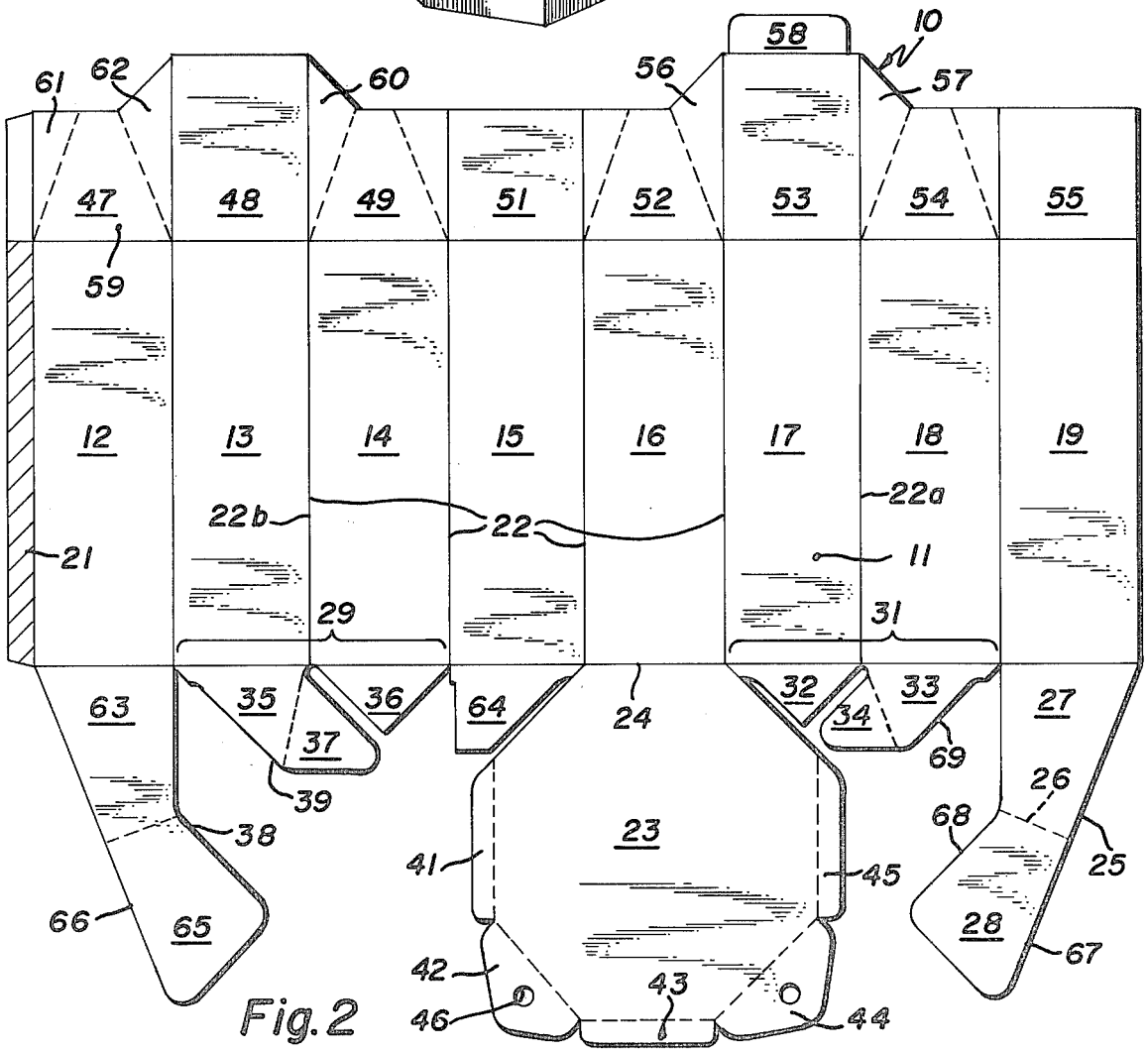
FIG. 2 is a diagram of the blank from which the container is formed.
Figure 3:
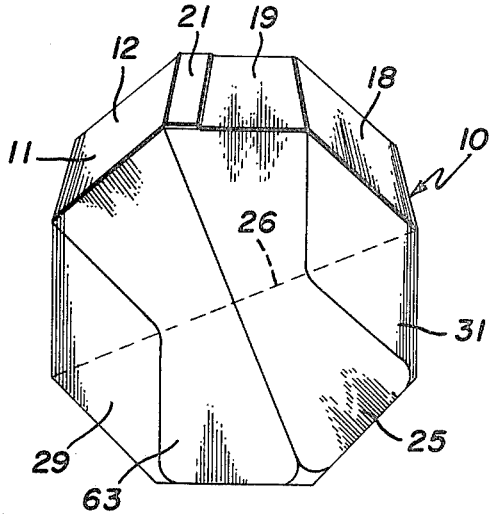
FIG. 3 is a perspective view of the container as observed from the bottom.

Referring to FIGS. 1, 2, and 3, which show the details of the invention, the container, indicated generally by the reference numeral 10, is shown as having a main body 11 consisting of eight rectangular panels 12–19, which are formed into a tube by cementing a flap 21 extending from the panel 12 to the surface of the panel 19. As shown in FIG. 2, the container is formed from a single blank of corrugated board and the drawing illustrates the surface which becomes the inside of the container. The panels are hingedly connected together in series along hinge lines 22 and is foldable into a flat condition to define an interior fold plane passing through the hinge lines 22*a* and 22*b*.

A bottom panel 23 of octagonal form has one of its side edges 24 hingedly connected to the bottom edge of the panel 16. The panel 16 and the hinge connection along the edge 24 are located mid-way between the hinge lines 22*a* and 22*b*, so that the bottom panel 23 can be swung up into the interior of the main body into the fold plane, when the container is collapsed. A locking tab 25 is hingedly attached to the bottom edge of the panel 19. A score or fold line 26 extends across the mid-point of the tab parallel to the hinge and divides it into a free portion 27 and a glue portion 28. The glue portion is permanently attached to the bottom panel 23 by the use of adhesive with the fold line 26 lying in the vertical plane of the hinge lines 22*a* and 22*b*. Two web elements 29 and 31 are provided (see FIG. 3). The web element 31 is made up of two generally triangular tabs 32 and 33 which are hingedly connected to the bottom edges of the panels 17 and 18, respectively. The tab 33 is provided with a glue extension 34 which is permanently attached to the tab 32. Similarly, the web element 29 is made up of two generally triangular tabs 35 and 36 which are hingedly attached to the bottom edges of the panels 13 and 14, respectively. The tab 35 is provided with a glue extension 37 by which it is permanently attached to the tab 36. The web elements and the locking tab are formed with matching edges, so that they lie in the same plane under the bottom panel 23 when the container is in operative unfolded condition.

A second locking tab 63 is hingedly connected to the main body panel 12, which, when the main body is assembled, is immediately adjacent to the panel 19 and the first-described locking tab 25. This second locking tab is divided by a fold line to provide a free portion and a glue portion 65 which is permanently attached by adhesive to a swing tab 64, which is hingedly attached to the lower edge of the panel 15. The locking tab 25 is provided with a concave curved edge 68 facing toward the web element 31 which has a convex curved edge 69. The locking tab 63 is provided with a concave curved edge 38 which is similar to a convex curved edge 39 on the web element 29, so that, as is obvious in FIG. 3, the locking tabs and the web elements provide a substantially continuous, co-planar, non-coextensive support for the bottom panel 23.

The two locking tabs 25 and 63 have adjacent straight edges 67 and 66, respectively, that extend perpendicular to the fold plane, so that they form an uninterrupted support for the bottom panel 23. Sealing flanges 41, 42, 43, 44, and 45 are provided along those side edges of the bottom panel 23 which are not contiguous to the side edge 24 where hinging takes place. At least the flange 42 is provided with a finger hole 46 to assist in pulling the bottom panel upwardly and collapsing the container.

The upper end of the main body 11 is provided with a plurality of closure panels 47–55 hingedly connected to the panels 12–19, respectively, of the main body. A primary closure panel 48 is capable of extending a substantial distance across the upper end of the main body and it has a panel portion 60 and 62 of triangular shape (forming part of the closure panels 47 and 49) on either side to form with it an open-ended envelope. A secondary closure panel 53 is located at the top of the panel 17 directly opposite the primary closure panel 48 to also extend a substantial distance across the upper end of the main body. The secondary closure panel 53 has an extension 58 adapted to fit snugly in the said envelope. The primary and secondary closure panels 48 and 53 extend completely across the upper end of the main body when the extension lies in the envelope and the container has been completely expanded for use. The closure panels are hingedly connected together and provided with fold lines, so that they form a continuous extension of the main body (when in open condition) and a substantially complete cover over the main body (when in closed condition). As is evident in FIG. 2, the closure panels alternate between rectangular first panels 48, 51, 53, and 55 on the one hand and gusseted second panels 47, 49, 52, and 54 on the other hand. Each of the second panels consists of a trapezoidal portion hingedly joined to triangular portions on either side, each triangular portion also being hingedly connected to an adjacent first panel. An example of this construction is the panel 47 which contains the trapezoidal portion 59 and the triangular portions 61 and 62. It should be noted that the panel 53 is provided with a triangular portion 56 on one side and a triangular portion 57 on the other side, these forming parts of the panels 52 and 54, respectively.

Figure 4:
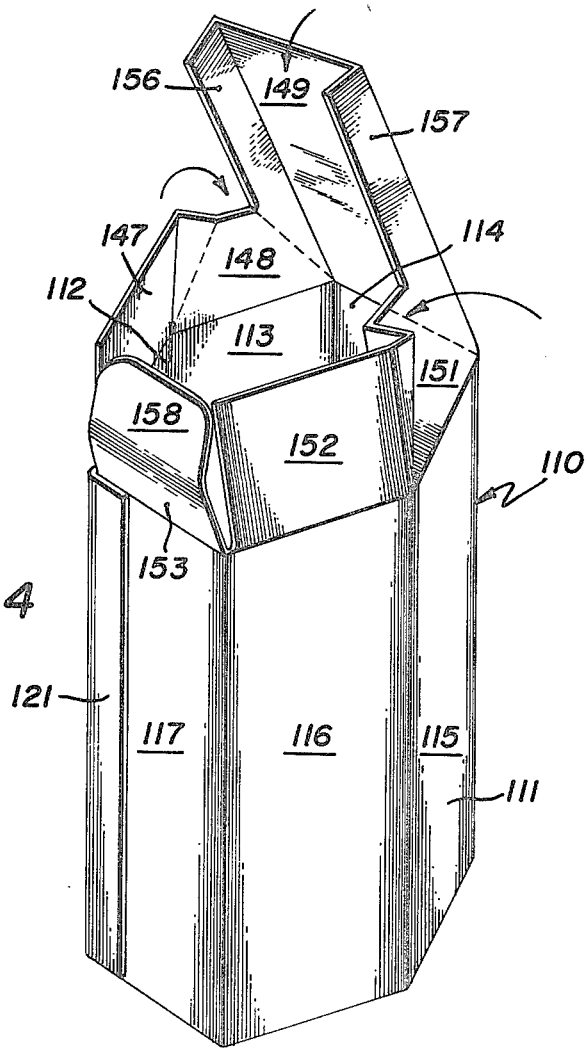
FIG. 4 is a perspective view of a modified form of the invention with a top closure in open position.
Figure 5:
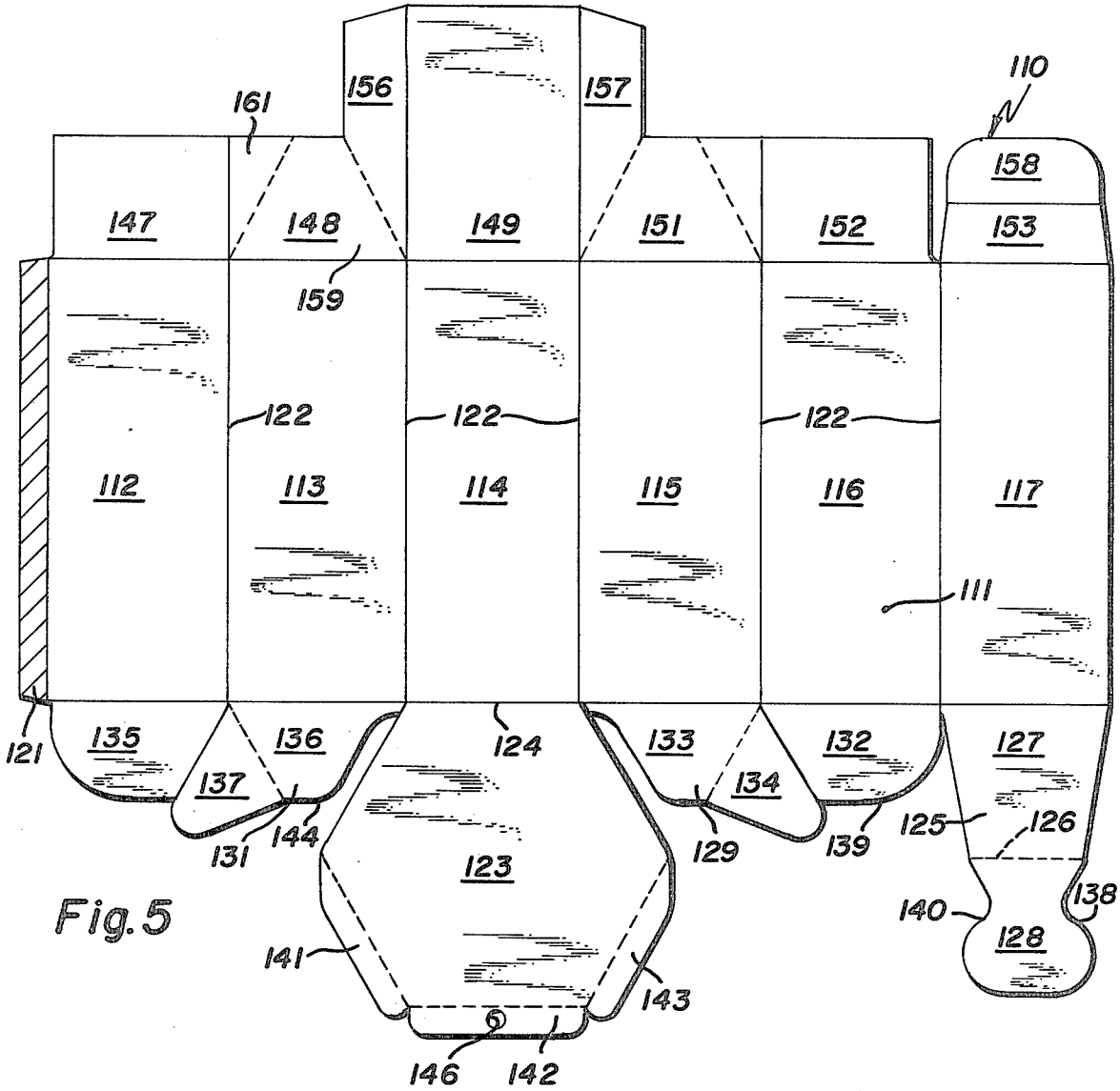
FIG. 5 is a diagram of a blank used in forming the container of FIG. 4.

FIGS. 4 and 5 shown the details of a modified version of the container. The container, indicated generally by the reference numeral 110, is shown as consisting of a main body 111 made up of six rectangular panels 112, 113, 114, 115, 116, and 117 which are connected seriatim along hinge lines 122 to form a tube. The main body is foldable into flat condition along opposite hinge lines to define a plane, when the body is collapsed. The tab 121 is provided to permit the connection of the panel 112 to the panel 117 to form the tube. The bottom panel 123 has the form of a hexagon, one side edge of which is hingedly connected to the bottom edge of the main body panel 114. The panel 114 is located mid-way between the opposite hinge lines about which the main body is collapsed, so that the bottom panel can be folded into the plane in the interior of the main body when it is folded. The bottom panel is hinged about its edge 124 to the panel 114. A locking tab 125 is hingedly attached to the bottom edge of the panel 117. It has a fold line 126 extending across its midpoint to divide it into a free portion 127 and a glue portion 128 which is intended to be permanently attached to the bottom panel 123 with the fold line lying in the fold plane of the main body. Two web elements 129 and 131 are provided to further support the bottom panel 123. The web element 129 consists of two tabs 132 and 133 which are hingedly connected to the bottom edges of the main body panels 116 and 115, respectively. The tab 133 is provided with a glue extension 134 for permanent attachment to the other tab 132. Similarly, the web element 131 consists of two tabs 135 and 136 which are hingedly connected to the bottom edges of the main body panels 112 and 113, respectively. The tab 136 is provided with a glue extension 137 by which it is permanently attached to the other tab 135. The locking tab 125 is provided with a concave curved edge 138 which faces toward the web element 129 which is, in turn, provided with a similar convex curved edge 139 that cooperates (during the erection of the container) with the curved surface 138. A similar concave surface 140 is located on the other side of the locking tab 125 for cooperation with a similar curved edge on the web element 131. Sealing flanges 141, 142, and 143 are provided on the bottom panel 123 and flange 142 is provided with a finger hole 146. The upper edge of the main body 111 is provided with a plurality of closure panels 147–153 which are hingedly connected to the upper edges of the panels 112–117, respectively, of the main body. The closure panel 149 is capable of extending more than half way across the upper end of the main body and has panel portions 156 and 157 on either side to form with it an openended envelope. The closure panel 153 is located opposite the closure panel 149 and also extends a substantial distance across the upper end of the main body. The closure panel 153 has an extension 158 adapted to fit snugly in the said envelope. The closure panels 149 and 153 extend completely across the upper end of the main body and lock together when the extension lies in the envelope and container is fully expanded. The closure panels 147–152 are hingedly connected together and provided with fold lines so that they form a continuous extension of the main body (when it is in open condition) and a substantially complete cover over the main body (when it is in closed condition). The closure panels 147, 149, and 152 are conventional rectangular panels. The panels 148 and 151, however, consist of a trapezoidal portion hingedly connected to angular portions on each side. For instance, the panel 148 is provided with a trapezoidal portion 159 a triangular portion 161, and an angled portion 156.

Figure 8:
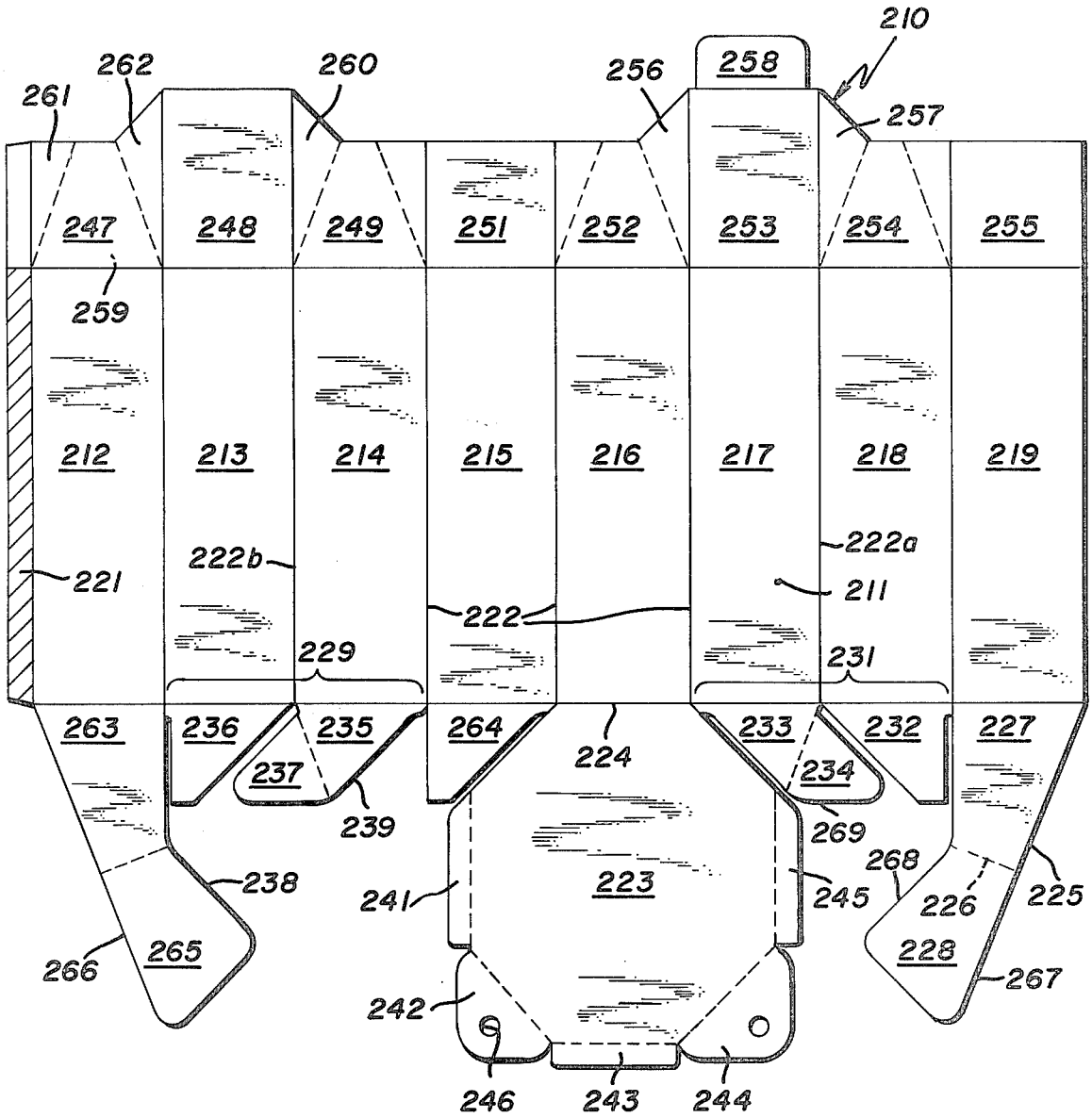
FIG. 8 is a diagram of a blank used in forming a still further modification of the invention.

Referring to FIG. 8, it can be seen that the modified form of the container indicated generally by the reference numeral 210, is shown as having a main body 211 consisting of eight rectangular handles 212–219, which are formed into a tube by cementing a flap 221 extending from the panel 212 to the surface of the panel 219. The container is formed from a single blank of corrugated board and the drawing illustrates the surface which becomes the inside of the container. The panels are hingedly connected together in series along hinge lines 222 and is foldable into a flat condition to define an interior fold plane passing through hinge lines **222*a* and 222*b*. The bottom panel 223 of octagonal form has one of its side edges 224 hingedly connected to the bottom edge of the panel 216. The panels 216 and the hinge connection along the edge 224 are located midway between the hinge lines 222*a* and 222*b*, so that the bottom panel 23 can be swung up into the interior of the main body into the fold plane when the container is collapsed. The locking tab 225 is hingedly attached to the bottom edge of the panel 219. A score or fold line 226 extends across the midpoint of the tab parallel to the hinge and divides it into a free portion 227 and a glue portion 228. The glue portion is permanently attached to the bottom panel 223 by the use of adhesive with the fold line 226 lying in the vertical plane of the hinge lines 222*a* and 222*b*. Two web elements 229 and 231 are provided, the web element 229 being made up of two generally triangular tabs 232 and 233 are hingedly connected to the bottom edges of the panels 218 and 217, respectively. The tab 233 is provided with a glue extension 234 which is permanently attached to the tab 232. Similarly, the web element 229 is made up of two generally triangular tabs 235 and 236 which are hingedly attached to the bottom edges of the panels 214 and 213, respectively. The tab 235 is provided with a glue extension 237 by which it is permanently attached to the tab 236. The web elements and the locking tab are formed with matching edges so that they lie in the same plane under the bottom panel 223** when the container is in operative unfolded condition.

A second locking tab 263 is hingedly connected to the main body panel 212 which, when the main body is assembled, is immediately adjacent the panel 219 and the first-described locking tab 225. This second locking tab is divided by a fold line to provide a free portion and a glue portion 265 which is permanently attached by adhesive to a swing tab 264 which is hingedly attached to the lower edge of the panel 215. The locking tab 225 is provided with a concave curved edge 268 facing toward the web element 231 which has convex curved edge 269. The locking tab 263 is provided with a concave curved edge 238 which is similar to a convex curved edge 239 formed on the web element 229, so that the locking tab and the web elements provide a substantially continuous, co-planar non-coextensive support for the bottom panel 223.

Two locking tabs 225 and 263 have adjacent straight edges 267 and 266, respectively that extends perpendicular to the fold plane, so that they form an uninterrupted support for the bottom panel 223. Sealing flanges 241, 242, 243, 244, and 245 are provided along those side edges of the bottom panel 223 which are not contiguous to the side edge 224 where hinging takes place. At least one of the flanges such as flange 242, is provided with a finger hold 246 to assist in pulling the bottom panel upwardly and collapsing the container.

The upper end of the main body 211 is provided with a plurality of closure panels 247 and 211, respectively, of the main body. A primary closure panel 248 is capable of extending a substantial distance across the upper end of the main body and it has a panel portion 260 and 262 of triangular shape (forming part of the closure panels 247 and 249) on either side to form with it an open-ended envelope. A secondary closure panel 253 is located at the top of the panel 217 directly opposite the primary closure panel 248 to also extend a substantial distance across the upper end of the main body. The secondary closure panel 253 has an extension 258 adapted to fit snugly in the said envelope. The primary and secondary closure panels 248 and 253 extend completely across the upper end of the main body when the extension lies in the envelope and the container has been completely expanded for use. The closure panels are hingedly connected together and provided with fold lines, so that they form a continuous extension of the main body when in open condition and a substantially cover over the main body when in closed position. As is evident in the drawing, the closure panel alternate between rectangular first panels 248, 251, 253, and 255 on the one hande and gusseted the second panels 247, 249, 252, and 254 on the other hand. Each of the second panels consist of a trapezoidal portion hingedly joined to triangular portions on either side, which triangular portion also being hingedly connected to adjacent first panel. An example of this construction is the panel 247 which contains the trapezoidal portion 259 and the triangular portions 261 and 262. It should be noted that the panel 253 is provided with a triangular portion 256 on one side and a triangular portion 257 on the other side, these forming parts of the panels 252 and 254, respectively.

The operation and the advantages of the present invention will now be readily understood in view of the above description.

Referring to FIGS. 1–3, it can be seen that the bottom structure makes use of the bottom panel 23 supported by the two locking tabs 25 and 63 and by the web elements 31 and 29. Because of the cooperative conjunction of the edges 39 and 69 of the web elements with the curved edges 38 and 68 of the lock tabs, these elements act fully to support the bottom panel 23 and the load which lies within the container. Because they are noncoextensive, there are no protuberances to press upward against the bottom panel and to distort it. The net effect is that the bottom structure is very strong and is substantially leak-proof, particular when the container is holding particular material. Nevertheless, the entire container can be collapsed by lifting the bottom 23 (by use of the finger hole 46 in the flange 42) and then pressing it together into a flat condition about the hinge lines 22*a* and 22*b*. When the container is expanded and when closure panels 47–55 are bent inwardly of the container, eventually the extension 58 and the panels 53 fits into the envelope formed by the panel 48 and the angular portion 60 and 62 which lie on either side of it. Further downward movement causes these element to lock across the top of the barrel and provide a strong impervious closure. Since the container is made of corrugated paper, it is very light, which means that it not only does not add appreciably to the shipping cost of the product, but it is easily moved around in storage and return shipped to the supplier.

Figure 6:
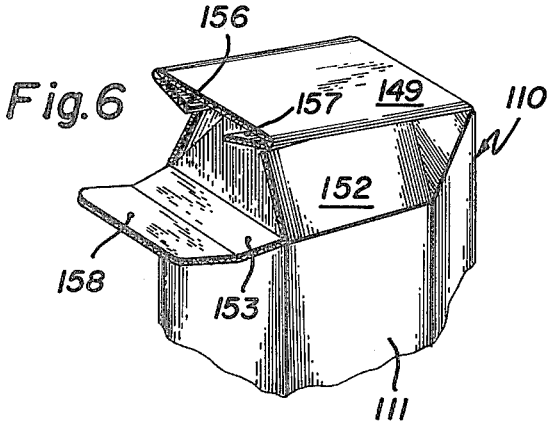
FIG. 6 is a perspective view of the top of the container with the closure partly closed.
Figure 7:
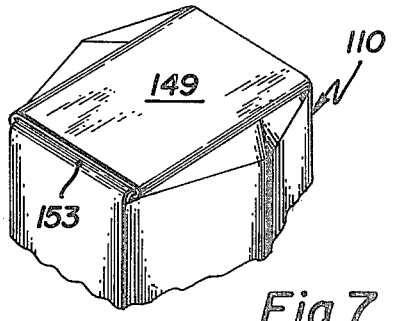
FIG. 7 is a perspective view of the container with the closure closed.

Referring to FIGS. 4–7, it can be seen that the container 110 is also formed of corrugated paper which can be folded flat for return or storage. The bottom panel 123 in the assembled container is supported practically continuously, because of the fact that the curved edges 139 and 144 of the web elements 129 and 131, respectively, fit into the curved edges 138 and 140 of the locking tube 125. This not only provides a very strong bottom structure, but also one that is free of leaks when the container contains fungible material such as powders. In FIG. 4 the closure structure is shown in open condition, so that the panel 149 and its laterally-arranged portions 156 and 157 may be used as a nozzle for pouring materials, such as plastic beads, into the hopper of a plastic injection molding machine. In order to close the closure structure, the condition shown in FIG. 6 is brought about and the closure panels are all moved inwardly. Eventually, the extension 158 is inserted into the envelope formed by the panels 149 and its associated panel portions 156 and 157. Finally, as shown in FIG. 7, the panels 153 and 149 are pressed sharply downwardly to lock all of the other closure panels under them in place and to lock the container in its expanded operative condition.

The form of the invention shown in FIG. 8 operates in substantially the same manner.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Container, comprising:

(a) a main body consisting of an even number of rectangular panels hingedly connected along hinge lines seriatim to form a tube, the body being foldable flat along opposite hinge lines to define a plane, (b) a bottom panel having the form of a regular polygon having the said even number of edges, one edge of the bottom panel being hingedly connected to the bottom edge of a first one of the panels, the said first one of the panels being located between the said opposite hinge lines, so that the bottom panel can be folded into the plane in the interior of the main body when it is folded, (c) a locking tab hingedly attached to the bottom edge of a second one of the panels, the locking tab having a fold line extending across its mid-point to divide it into a free portion and a glue portion, the glue portion being adapted to be permanently attached to the bottom panel with the fold line lying in the said plane, (d) a web element adjacent each of said opposite hinge lines consisting of two generally triangular tabs hingedly connected to the bottom edges of the two adjacent panels which extend along the opposite hinge line, one of the tabs having a glue extension for permanent attachment to the other tab, and (e) said locking tab being formed with a concave curved edge facing each of the said web elements and each of said web elements being provided with a convex curved edge that conforms to the adjacent concave edge of the locking tab, so that the locking tab and the web elements lie substantially in the same plane under the bottom panel and provide a substantially continuous support for the bottom panel.

2. Container as recited in claim 1, wherein eight panels are provided to form a main body of octagonal cross-section, wherein the bottom panel is also octagonal, wherein the locking tab is divided into two portions hingedly connected to adjacent panels, and wherein a tab is hingedly attached to one of the panels immediately adjacent the bottom panel for attachment to a glue portion of one of said locking tab portions, the glue portion of the other of said tab portions being attached to said bottom panel.

3. Container as recited in claim 2, wherein the two locking tab portions have adjacent straight edges that extend perpendicularly to the fold plane, so that they form an uninterrupted support for the bottom panel.

4. Container as recited in claim 1, wherein sealing flanges are provided along many of the edges of the bottom panel to extend upwardly along the inside surface of the main body, at least one of the flanges located opposite the edge of the panel which is hingedly connected to the main body being provided with a finger hole to assist in pulling the bottom panel upwardly and collapsing the container.

5. Container as recited in claim 1, wherein the upper end of the main body is provided with a plurality of closure panels hingedly connected to the said panels of the main body, one primary closure panel being capable of extending at least one-half way across the upper end of the main body and having a panel portion on either side to form with it an open-ended envelope, one secondary closure panel being located opposite the primary closure panel to extend a substantial distance across the upper end of the main body, the secondary closure panel having an extension adapted to fit snugly into the said envelope, the primary and secondary closure panels extending completely across the upper end of the main body when the extension lies in the envelope.

6. Container as recited in claim 5, wherein the closure panels are hingedly connected together and provided with fold lines, so that they form a continuous extension of the main body when in open condition and a substantially complete cover over the main body when in closed condition.

7. Container as recited in claim 6, wherein the closure panels alternate between rectangular first panels, on the one hand, and second panels, on the other hand, each of the second panels consisting of a trapezoidal portions hingedly joined to triangular portions on either side, each triangular portion also being hingedly connected to an adjacent first panel.

8. Container, comprising:

(a) a main body consisting of eight rectangular panels hingedly connected along hinge lines seriatim to form a tube, the body being foldable flat along opposite hinge lines to define a plane, (b) a bottom panel having the form of a regular polyhedron having eight edges, one edge of the bottom panel being hingedly connected to the bottom edge of the first one of the panels, the said first one of the panels being located between the said opposite hinge lines, so that the bottom panel can be folded into the plane in the interior of the main body when it is folded, (c) a first locking tab hingedly attached to the bottom edge of a second one of the panels, the first locking tab having a fold line extending across its mid-point to divide it into a free portion and a glue portion, the glue portion being adapted to be permanently attached to the bottom panel with the fold line lying in the said plane, (d) a second locking tab hingedly connected to a third one of the panels located immediately adjacent the said second one of the panels, the second locking tab having a fold line extending across its mid-point to divide it into a free portion and a glue portion, (e) a swing tab hingedly attached to a fourth one of the panels immediately adjacent the bottom panel for attachment to the glue portion of said second locking tab to enable the second locking tab to swing away from said first locking tab when the container is folded along said opposite hinge lines, and (f) two web elements, each consisting of two generally triangular tabs hingedly connected to the bottom edges of adjacent panels, one of the tabs having a glue extension for permanent attachment to the other tab, the web elements and the locking tab being formed with matching edges, so that they lie in the same plane under the bottom panel.

9. Container as recited in claim 2, wherein the two locking tabs have adjacent edges that extend perpendicularly to the fold plane, so that they form an uninterrupted support for the bottom panel.

10. Container as recited in claim 8, wherein each locking tab portion with a concave curved edge facing one of the web elements, wherein each web element is provided with a concave curved edge that conforms to the edge of its adjacent locking tab, so that the locking tabs and the web elements provide a substantially uninterrupted support for the bottom panel.

* * * * *